United States Patent [19]

Whiting

[11] 4,079,617

[45] Mar. 21, 1978

[54] PNEUMATIC PRESS

[76] Inventor: Richard B. Whiting, P.O. Box 30, Oakland, Ontario, Canada

[21] Appl. No.: 786,446

[22] Filed: Apr. 11, 1977

[51] Int. Cl.[2] ..... B21J 9/12

[52] U.S. Cl. ..... 72/404; 72/453.02; 72/453.06; 72/453.07; 72/453.08; 72/455; 83/619; 100/231; 100/269 B

[58] Field of Search ..... 72/404, 453.01, 453.02, 72/453.06, 453.07, 453.08, 455; 83/618, 619, 620; 100/231, 269 R, 269 B, 266

[56] References Cited

U.S. PATENT DOCUMENTS

| | | | |
|---|---|---|---|
| 1,007,349 | 10/1911 | Gerdau | 100/269 B |
| 1,054,194 | 2/1913 | Gerdau | 100/269 B |
| 1,230,486 | 6/1917 | Jacomini | 100/269 B |
| 2,482,280 | 9/1949 | Lerma | 72/453.02 |
| 2,677,426 | 5/1954 | Glitsch | 83/619 |
| 3,213,739 | 10/1965 | Zingone | 100/269 R |
| 3,253,493 | 5/1966 | Weisbeck | 83/619 |

*Primary Examiner*—C.W. Lanham
*Assistant Examiner*—Gene P. Crosby
*Attorney, Agent, or Firm*—Fetherstonhaugh & Co.

[57] ABSTRACT

A pneumatic metal forming press which employs at least one pneumatic drive unit which has an expansion chamber defined by a flexible diaphragm acting on a support mechanism and a shock absorber underlying the support mechanism to absorb the impact thereof following the release of a working tool such as a punch after penetration of a work piece during a working stroke. The drive unit may incorporate a plurality of diaphragm chambers arranged one above the other and connected in parallel to a source of high pressure air. The drive unit may also incorporate a pressure multiplier having a fluid chamber pressurized in response to movement of the diaphragm of a drive mechanism and an output drive shaft driven in response to pressure thereto by the fluid in the multiplier chamber. The drive mechanism may also incorporate a secondary drive mechanism operable to locate the working tool closely adjacent a work piece prior to commencement of the working stroke so that although the press may have a short working stroke, it has the ability to open and close over a substantial operating stroke.

12 Claims, 6 Drawing Figures

PNEUMATIC PRESS

This invention relates to metal forming presses and the like. In particular, this invention relates to improvements in the drive mechanism of a metal forming press.

The conventional brake press which is in wide use in industry today is relatively expensive. The cost of the conventional brake press increases substantially as the length of its working stroke and power rating increases.

The apparatus of the present invention provides a metal forming machine which is considerably less expensive than a comparable brake press.

Air brakes are used extensively in commercial vehicles and are produced in such large quantities that the component parts thereof, such as the air brake diaphragm units, are relatively inexpensive. These relatively inexpensive air brake diaphragm units are modified in accordance with the present invention to provide a suitable drive mechanism for driving a pneumatic press.

In the conventional air brake diaphragm unit, the diaphragm chamber is expanded to apply the brakes or to release the safety brakes and the resistance to expansion of the diaphragm chamber increases progressively as the diaphragm chamber expands. These operating conditions do not, however, exist in a metal forming apparatus such as a punch wherein the load increases progressively until the work piece is sheared by the punch and thereafter there is an immediate decrease in the load. Because of this substantial difference in loading characteristics, it would appear that the air diaphragm unit used in a brake installation is unsuitable for use in a metal forming operation. However, this difficultly has been overcome by providing a shock absorber within the housing to absorb the impact of the diaphragm support mechanism following penetration of a work piece.

In many applications, a single air brake diaphragm unit is quite sufficient to provide all of the pressure required in a small punching operation. If, however, increased pressure is required, the apparatus of the present invention can be modified by adding additional diaphragm chambers to the drive unit by stacking them one on top of the other with the drive shaft thereof in axial alignment and engaging one another to operate in unison and by connecting the diaphragm chambers thereof in parallel with one another to a source of air.

In some applications, a substantial pressure may be required at the pressure plate of the press while only a short working stroke is required. This objective can be achieved according to one aspect of the present invention by providing a pressure multiplier in the form of a fluid chamber in the drive shaft which effectively reduces the length of the working stroke of the drive shaft while increasing the pressure applied thereto.

In many applications, the working stroke of a press must be sufficient to enable a fairly large work piece to be located between the base and pressure plate thereof while the punch members may only be required to move a very short distance in order to penetrate a relatively thin metal member. An air brake diaphragm unit, of the type previously described, can be used in such an application as a primary drive mechanism when used in combination with a secondary drive mechanism. The primary drive mechanism includes an hydraulically extensible drive shaft which extends between the diaphragm and the pressure plate of the press. The secondary drive mechanism serves to extend the extensible shaft to locate the working end of the shaft closely adjacent the work piece before the primary drive mechanism is activated to move the shaft towards the work piece in its working stroke. In effect, this mechanism provides a low pressure drive mechanism for locating the working tool closely adjacent the work piece and a high pressure drive mechanism for driving the work piece over its working stroke.

SUMMARY OF INVENTION

According to one aspect of the present invention, there is provided a press having a frame, a base plate on said frame, a pressure plate mounted on said frame for movement towards and away from said base plate, at least one punch assembly located between said base plate and said pressure plate, each punch assembly having a working stroke operable in response to movement of said pressure plate with respect to said base plate, the improvement of at least one pneumatic drive unit, each pneumatic drive unit comprising a housing having a main chamber located therein, a pressure responsive diaphragm mounted in said housing and dividing said main chamber into a pressure chamber and a vent chamber, air inlet passage means opening into said housing and communicating with said pressure chamber for supplying air under pressure to said pressure chamber to activate said diaphragm, a substantially rigid stiffener plate mounted on said diaphragm, a drive shaft having an inner end mounted on said stiffener plate for movement therewith in response to movement of said diaphragm and an outer end projecting outwardly from said housing through said vent chamber and communicating with said pressure plate to drive said pressure plate and thereby drive said punch assembly in response to movement of said diaphragm, and shock absorber means underlying said stiffener plate to absorb the impact of the stiffener plate following the release of the punch after penetration of a work piece during a working stroke thereof.

According to a further aspect of the present invention, there is provided a press having a frame, a base plate on said frame, a pressure plate mounted on said frame for movement towards and away from said base plate, at least one punch assembly located between said base plate and said pressure plate, each punch assembly having a working stroke operable in response to movement of said pressure plate with respect to said base plate, the improvement of at least one pneumatic drive unit, each pneumatic drive unit comprising a housing having a plurality of main chambers disposed one above the other, a pressure responsive diaphragm mounted in each main chamber and dividing each main chamber into a pressure chamber and a vent chamber, air inlet passage means opening through said housing into each of said pressure chambers for supplying air under pressure to each pressure chamber to activate each diaphragm, a substantially rigid stiffener plate mounted on each diaphragm, drive shaft means extending within said main chamber and having one end projecting outwardly therefrom and connected to said pressure plate, said drive shaft being drivingly connected to each of said stiffener plates for movement therewith in response to movement of said diaphragm whereby the pressure within each pressure chamber is applied to said drive shaft means, shock absorber means underlying at least the lowermost stiffener plate to absorb the impact of said lowermost stiffener plate following the release of the punch after penetration of a work piece during a working stroke thereof.

According to a still further aspect of the present invention, there is provided a press having a form, a base plate on said frame, a pressure plate mounted on said frame for movement towards and away from said base plate, at least one punch assembly located between said base plate and said pressure plate, each punch assembly having a working stroke operable in response to movement of said pressure plate with respect to said base plate, the improvement of a drive mechanism comprising a primary drive mechanism operable to drive the punch mechanism in its working stroke and a secondary drive mechanism operable to locate the punch closely adjacent the work piece prior to commencement of the working stroke, said primary drive mechanism comprising at least one primary drive unit comprising a main housing having a main chamber located therein, a pressure responsive diaphragm mounted in said housing and dividing said main chamber into a pressure chamber and a vent chamber, air inlet passage means opening into said housing and communicating with said pressure chamber for supplying air under pressure to said chamber to activate said diaphragm, a substantially rigid stiffener plate mounted on said diaphragm, a drive shaft having an inner end mounted on said stiffener plate for movement therewith in response to movement of said diaphragm, and an outer end projecting outwardly from said housing through said vent chamber, shock absorber means underlying said stiffener plate to absorb the impact of the stiffener plate following the release of the punch mechanism after penetration of the work piece during said working stroke, a pressure multiplier housing disposed between said main housing and said frame, a fluid chamber in said pressure multiplier housing, said fluid chamber having a first portion opening outwardly from one end thereof and adapted to sealingly receive said outer end of said drive shaft in a close fitting sliding relationship, and a second portion of greater cross-sectional area than said first portion, said second portion opening outwardly from the other end of said housing a piston slidably mounted in said second portion and having a piston rod projecting outwardly through said other end of said housing and engaging said pressure plate, an hydraulic fluid reservoir, passage means communicating between said reservoir and said fluid chamber and valve means in said passage means for controlling the admission of fluid to said fluid chamber and the venting of fluid from said fluid chamber; said secondary drive mechanism comprising at least one secondary drive unit comprising a longitudinally extensible unit having a first end secured to said frame and a second end secured to said pressure plate, said longitudinally extensible unit being extensible in a first direction to move said pressure plate and thereby move said piston of said pressure multiplier away from said shaft of said primary drive unit and thereby expand the capacity of said fluid chamber and draw hydraulic fluid into said fluid chamber, thereby increasing the effective length of said primary drive, said longitudinally extensible unit being retractable to lift said pressure plate away from a work piece and vent hydraulic fluid from said fluid chamber upon completion of said working stroke of said primary drive mechanism.

According to yet another aspect of the present invention, there is provided a press having a frame, a base plate on said frame, a pressure plate mounted on said frame for movement towards and away from said base plate, at least one punch assembly located between said base plate and said pressure plate, each punch assembly having a working stroke operable in response to movement of said pressure plate with respect to said base plate, the improvement of at least one pneumatic drive unit, each pneumatic drive unit comprising primary pneumatic drive means comprising an expansible diaphragm valve member having a diaphragm which is movable in response to a variation in pressure in the valve member, an hydraulically extensible drive unit connecting said diaphragm and said pressure plate, said hydraulically extensible drive unit having an expansible hydraulic chamber located therein and being movable between an extended position and a retracted position in response to expansion and contraction of said expansible hydraulic chamber, a source of hydraulic fluid communicating with said expansible hydraulic chamber for supplying hydraulic fluid to said chamber as said hydraulically extensible drive unit expands and receiving hydraulic fluid from said expansible chamber as said hydraulically extensible drive unit contracts; said secondary drive means comprising an extensible second drive unit having a first end connected to said frame and a second end connected to said pressure plate, said second drive means being extensible and retractable to move said pressure plate over a substantial distance towards and away from a work piece to expand and contract said hydraulically extensible drive unit of said primary drive means.

PREFERRED EMBODIMENT

The invention will be more clearly understood after reference to the following detailed specification read in conjunction with the drawings, wherein FIG. 1 is a pictorial view of a metal forming press according to an embodiment of the present invention;

Figure 1:
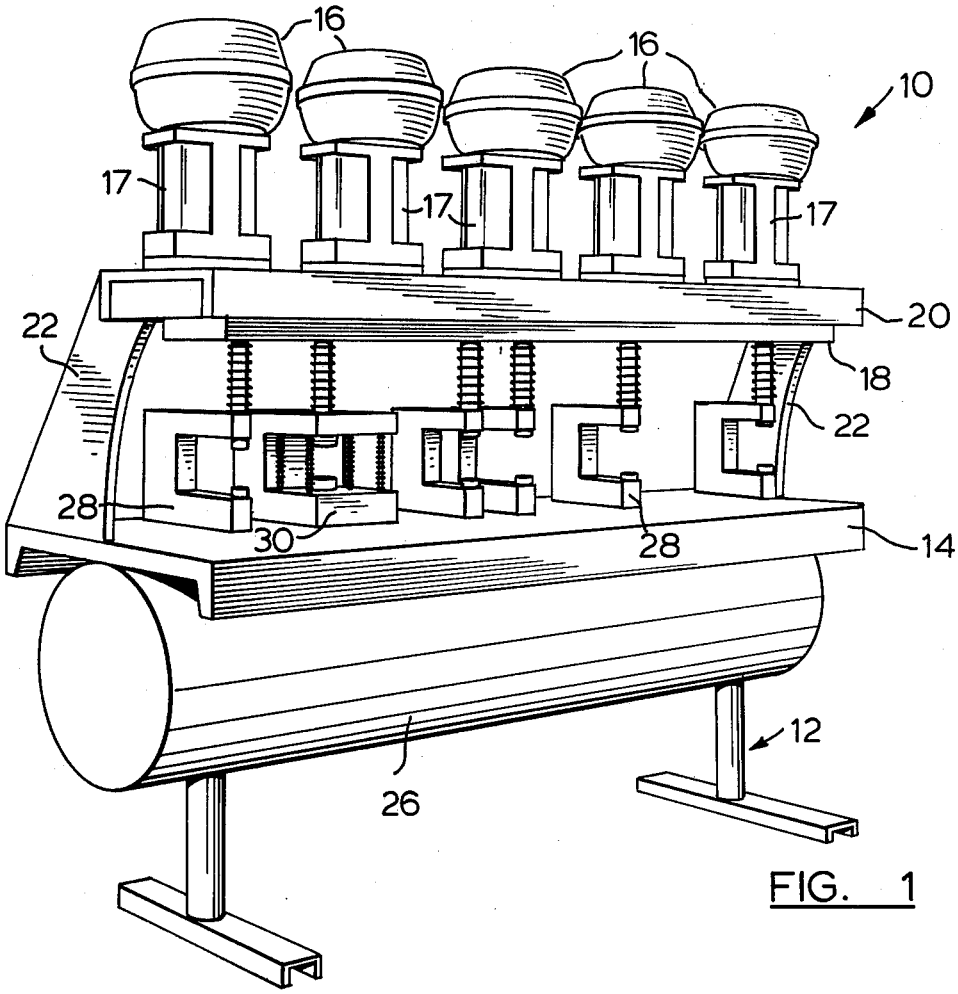

With reference to FIG. 1 of the drawings, the reference numeral 10 refers generally to a press according to an embodiment of the present invention. The press 10 consists of a frame 12 which supports a base plate 14 and a plurality of pneumatic drive units 16. A pressure plate 18 is carried by the pneumatic drive units 16 and mounted for reciprocal movement relative to the frame 12 towards and away from the base plate 14. The frame 12 includes a mounting plate 20 which is supported above the base plate 14 by a plurality of brace plates 22. The frame 12 also includes a longitudinally extending conduit 26 which forms an air reservoir for the pneumatic drive units 16. Any one of a number of different types of metal forming units such as the punches generally identified by the reference numerals 28 and 30 may be located between the base plate 14 and the pressure plate 18, movement of the pressure plate 18 towards the base plate 14 serving to operate the punches 28 and 30.

In the embodiment illustrated in FIG. 1 of the drawings, pressure multipliers 17 is located between the pneumatic drive units 16 and the support 20.

Figure 2:
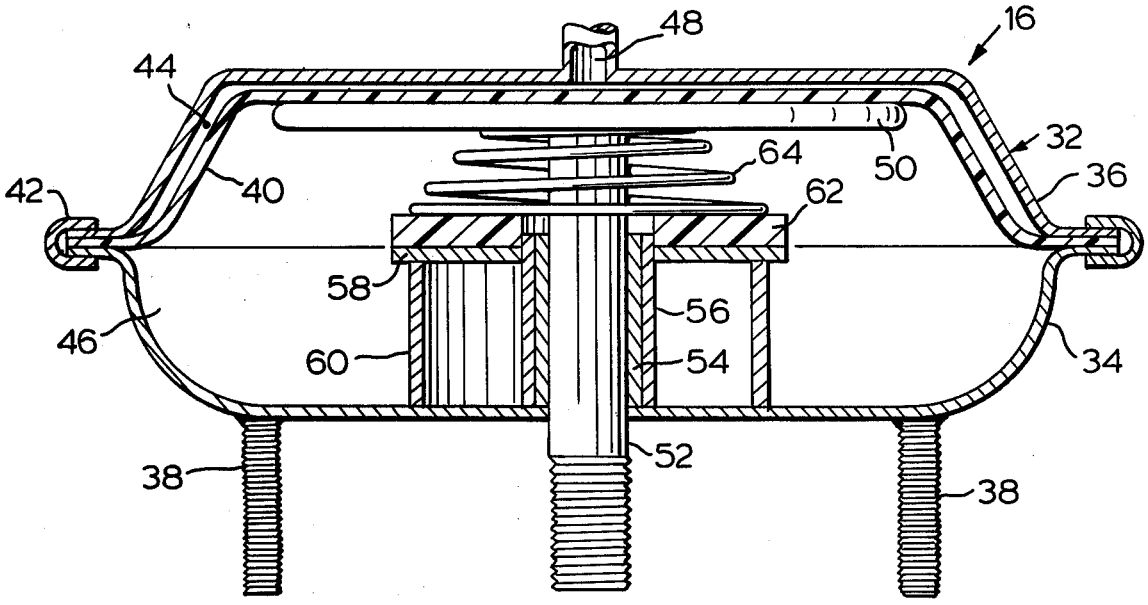
FIG. 2 is a longitudinal sectional view through a pneumatic drive unit according to one aspect of the present invention.

A major portion of the structure of the pneumatic drive unit 16 is available in the form of an air brake unit of the type commonly used in commercial road-going vehicles. FIG. 2 of the drawings is a sectional view through a pneumatic drive unit which is a modified air brake unit. The pneumatic drive unit 16 consists of a housing generally identified by the reference numeral 32. The housing 32 consists of a lower dish-shaped section 34 which is vented to atmosphere and an upper dish-shaped section 36. Mounting bolts 38 are secured to the lower section 34. In an application where a pressure multiplier 17 is not required, the lower dish section 34 may be secured directly to the frame of the press. A flexible diaphragm 40 is clamped between the upper and lower sections 36 and 34 of the housing which are secured by means of a clamping ring 42. The diaphragm 40 divides the main chamber of the housing into a pressure chamber 44 and a vent chamber 46. A passage 48 opens through the wall of the pressure chamber 44 and is connected to a source of high pressure air so that the pressure chamber 44 may be pressurized. A stiffener plate 50 is located below the inner face of the diaphragm 40 and a shaft 52 is connected to the stiffener plate 50 and projects outwardly through the lower portion 34 of the housing. An elongated bush 54 is supported by a sleeve 56 which is mounted on the lower portion 34 of the housing and serves to guide the shaft 52 as it is reciprocally driven in use. An annular platform 58 is supported within the main chamber of the housing by means of a tubular support post 60 which extends around the sleeve 56. The overall height of the support post 60 is used to limit the working stroke of the unit to suit various applications. The annular shock absorber disc 62 is mounted on the platform 58 directly below the stiffener plate 50. The shock absorber disc 62 is preferably made from a resilient material such as urethane or the like. A coil spring 64 extends between the shock absorber disc 62 and the stiffener plate 50. The coil spring 64 normally urges the diaphragm 40 to the raised position shown in FIG. 2 of the drawings.

In use, high pressure air is directed to the pressure chamber 44 through inlet passage 48. The air pressure is applied to the diaphragm 40 and as the pressure increases, the pressure chamber expands to move the drive shaft towards the work piece while comprising the spring 64. When the tool such as a punch makes contact with the work piece, the pressure in the pressure chamber 44 will increase to that required in order to drive the tool, such as a punch, through the body of the work piece. It will be apparent that after the tool has penetrated the work piece, the resistance to further movement thereof is greatly reduced and this sudden reduction in pressure will result in a rapid expansion of the pressure chamber 44. As a result of this rapid expansion, the stiffener plate 50 will be driven against the shock absorber disc 62. It has been found that an annular shock absorber disc of urethane is sufficient to absorb the impact on release of resistance to movement of a punch or the like. In a pneumatic unit having a 10 inch diameter housing of the type commonly used in air brake units, a urethane cushion measuring 5/16 inch in thickness and having an internal diameter of 1½ inch and an external diameter of about 4 inches provides an adequate shock absorber.

The conventional air brake unit of the type described will provide a working stroke of about 3 inches. In many applications, this stroke is adequate. The pressure available in this apparatus can be up to 36 times the line pressure so that a two ton pressure is available with a line pressure of approx. 110 p.s.i..

Figure 3:
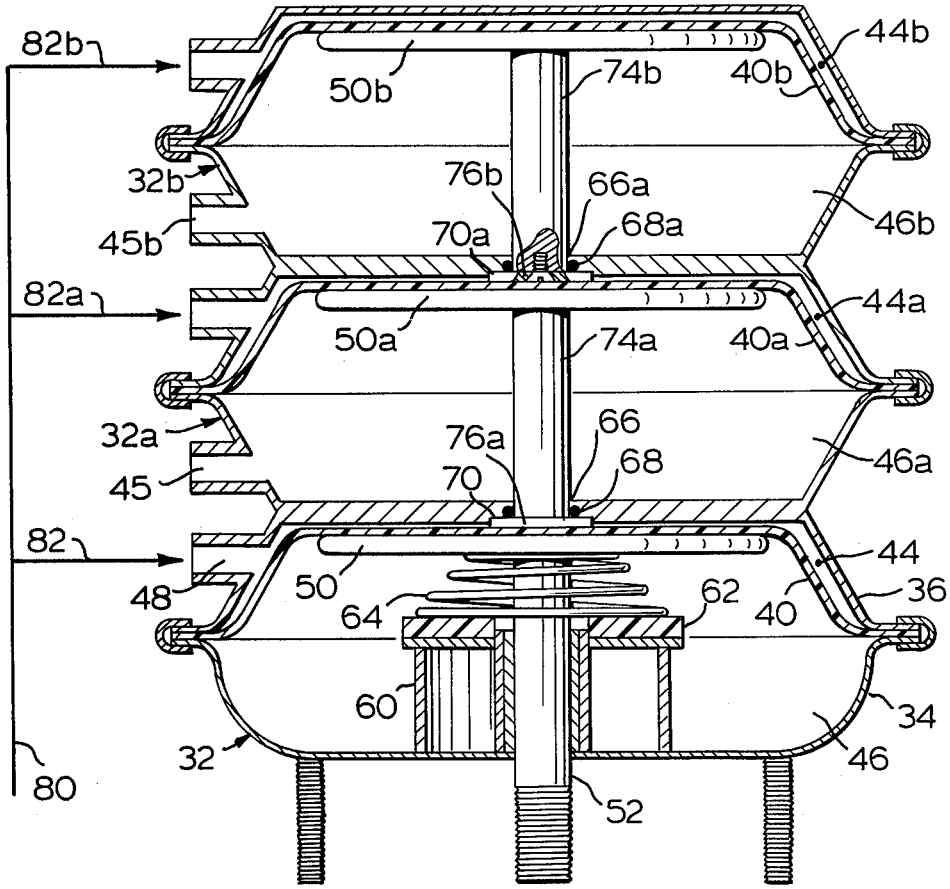
FIG. 3 is a longitudinal sectional view through a pneumatic drive unit according to a further aspect of the present invention.

The basic pneumatic unit described above with respect to FIG. 2 of the drawings may be modified to provide increased pressure in the manner shown in FIG. 3 of the drawings. In this embodiment, the lower pneumatic unit is constructed substantially in accordance with the unit illustrated in FIG. 2 and will not, therefore, be described in detail. The housing 32 of FIG. 3 is modified in that the air inlet passage 48 is located in a side wall portion thereof. A passage 66 is formed in the upper wall of the upper portion 36 and an seal 68 is located in the passage 66. An enlarged recess 70 is located at the lower end of the passage 66. A second housing **32*a* is located on top of the first housing 32 and has a diaphragm 40*a* located therein dividing the chamber into a second pressure chamber 44*a* and a second vent chamber 46*a*. The second vent chamber 46*a* vents to atmosphere through a vent passage 45. A third housing 32*b* is mounted above the second housing 32*a* and has a diaphragm 40*b* dividing the chamber thereof into a pressure chamber 44*b* and a vent chamber 46*b*. The vent chamber 46*b* vents to atmosphere through a vent passage 45*b*. A passage 66*a* opens through the upper wall 36*a* of the second housing 32*a* and has sealing ring 68*a* located therein. A passage 66*a* has an enlarged portion 70*a* at the lower end thereof. A stiffener 50*a* is mounted below the diaphragm 40*a* and a stiffener 50*b* is mounted below the diaphragm 40*b*. Shafts 74*a* and 74*b* have their upper ends connected to stiffener plates 50*a* and 50*b* respectively and their lower ends extend through passages 66 and 66*a* respectively and are sealed therein by sealing rings 68 and 68*a* respectively. The shafts 74*a* and 74*b* have enlarged head portions 76*a* and 76*b* which extend into the enlarged recesses 70 and 70*a* when the diaphragms 50*a* and 50*b* are in the extended position shown in FIG. 3 of the drawings. The lower end of the shaft 74*a* rests on diaphragm 40 immediately above shaft 52 and the lower end of the shaft 74*b* rests on diaphragm 40*a* immediately above shaft 74*a* so that the shafts 52, 74*a* and 74*b* combine to provide a composite drive shaft. The pressure chambers 40, 40*a* and 40*b* are connected in parallel to air line 80 by air lines 82, 82*a* and 82*b*** respectively.

It will be apparent from the description of FIG. 3 that the total surface area of diaphragm communicating with the combined shafts 52, **74*a* and 74*b* is about three times greater than that provided by a corresponding unit constructed in accordance with FIG. 2. Thus, the unit illustrated in FIG. 3 of the drawings provides an increase in available power to about three times that available from the apparatus of FIG. 2. It will be understood that the proportions of the shock absorber 62** may be adjusted to take into consideration the increased force of the impact.

The pneumatic drive unit of FIG. 3 provides increased power over that available from the unit of FIG. 2 while maintaining a stroke length similar to that of the unit of FIG. 2. In many instances, a short stroke is all that is required although power greater than that available from a unit constructed in accordance with FIG. 2 is required. The apparatus of FIG. 4 provides a power multiplier which increases the power output of the pneumatic drive unit by reducing the length of the working stroke of the pressure plate 18.

Figure 4:
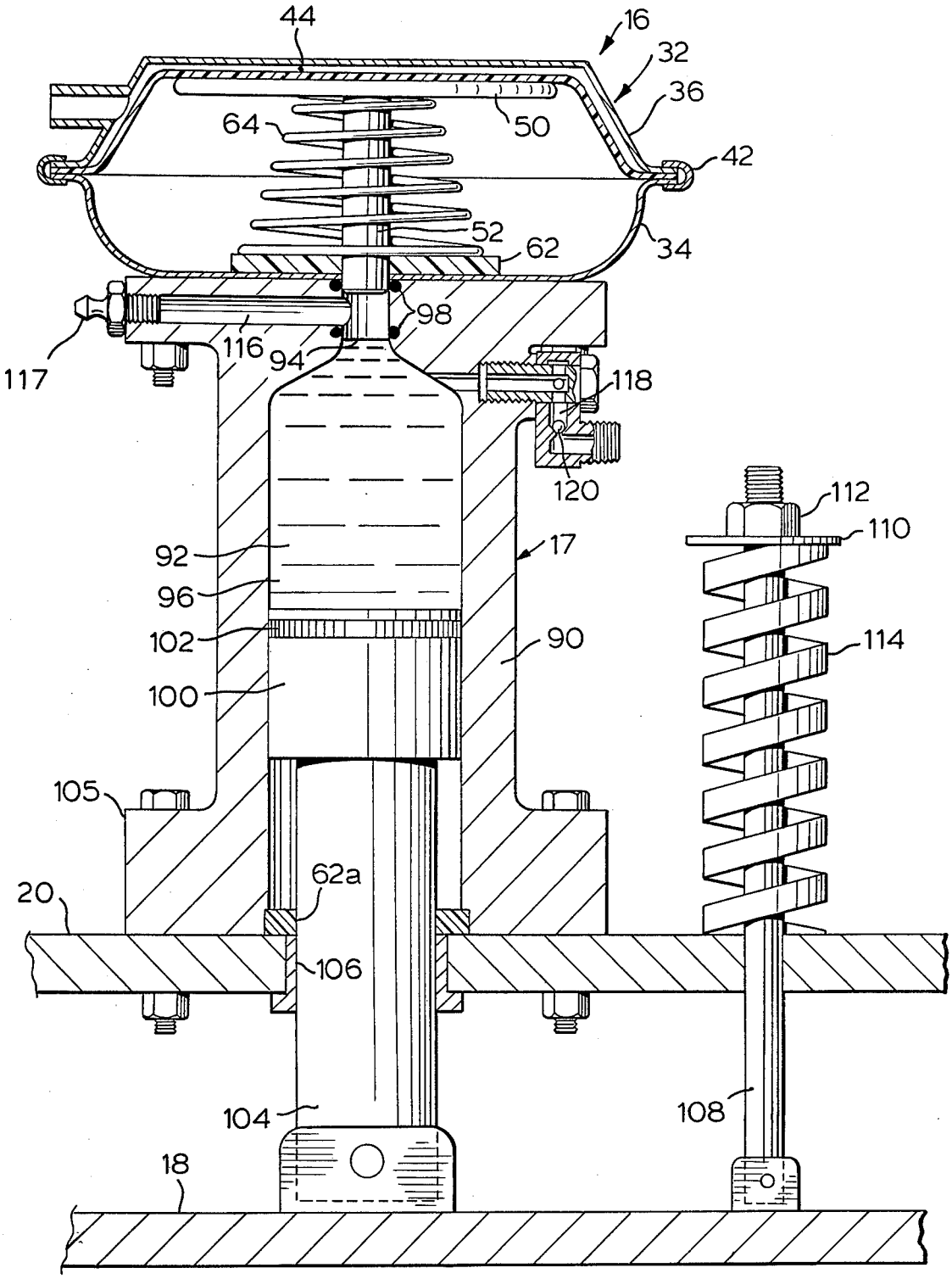
FIG. 4 is a longitudinal sectional view through a pneumatic drive unit incorporating a pressure multiplier.

With reference to FIG. 4 of the drawings, it will be seen that a pneumatic drive unit 16 is provided in combination with a power multiplier 17. The pneumatic drive unit 16 is constructed substantially in accordance with the unit described in FIG. 2 with the exception that the shock absorber 62 is mounted on the lower wall of the housing 32 and not upon a support structure. This enables the pneumatic drive unit 16 to operate over the full length of the stroke of a conventional air brake unit. The pressure multiplier 17 consists of a housing 90 which is formed with a fluid chamber which is generally identified by the reference numeral 92. The fluid chamber 92 consists of a first portion 94 which opens inwardly from one end thereof and a second portion 96 which opens outwardly from the opposite end thereof. The first portion 94 is of a diameter which is substantially smaller than the diameter of the second portion 96. The first portion 94 is adapted to receive the shaft 52 in a close fitting sliding relationship. O-ring 98 is provided in the first portion 94 to sealingly engage the shaft 52. A piston 100 is mounted to reciprocate within the second portion 96 and has a sealing piston ring 102 which serves to prevent the escape of fluid from the chamber 92. A piston rod 104 extends downwardly from the piston 100 and rests at its lower end on the pressure plate 18. A second annular shock absorbing pad **62*a* is located at the bottom end of the portion 96 of the chamber 92 to absorb the shock of impact of the piston 100 after the work piece yields in a metal forming operation. The housing 90 has a flange 105 at the lower end thereof which is bolted to the support plate 20. A passage 106 in the support plate 20 is of a smaller diameter than the diameter of the second portion 96 so that it forms a shoulder for supporting the second shock absorber pad 62*a*. A reset rod 108 is secured at its lower end to the pressure bar 18 and extends upwardly through the mounting plate 20 and has a washer 110 secured at the upper end thereof by means of a nut 112. A compression spring 114 extends between the washer 110 and the support plate 20**.

The fluid chamber 92 communicates with a reservoir of hydraulic fluid through inlet passage 118. A one-way check valve 120 is located in the inlet passage 118. A bleed passage 115 opens outwardly from the chamber 92 and has a bleed nipple 117 at the outer end thereof.

In use, air is supplied to the pressure chamber 44 as previously described with reference to FIG. 2 to expand the pressure chamber 44 and move the shaft 52 downwardly into the upper portion 94 of the fluid chamber 92. Downward movement of the shaft 52 closes the vent passage 116 and continued downward movement of the shaft 52 applies a pressure to the fluid within the chamber 92 and thereby forces the piston 100 downwardly. The load multiplication obtained by the multiplier 17 is a function of the ratio of the cross-sectional area of the piston 100 to that of the shaft 52. Similarly, the length of the working stroke of the piston is a function of the ratio cross-sectional area of the piston 100 to that of the shaft 52. The pressure multiplier increases the load available at the piston rod 104 while decreasing the length of stroke available. After the working stroke has been completed, air is vented from the pressure chamber 44. The reset spring 114 than asserts itself to apply sufficient pressure to the fluid in the chamber 92 to raise the shaft 52 until it returns to its uppermost position along with pressure bar 18. The pressure in the fluid within the chamber 92 serves to close the check valve 120, preventing the discharge of fluid through the check valve 120. Oil lost through leakage will be replaced via check valve 120 from the oil reservoir. The bleed nipple may be used when necessary to vent any air that should find its way into the system.

Figure 5:
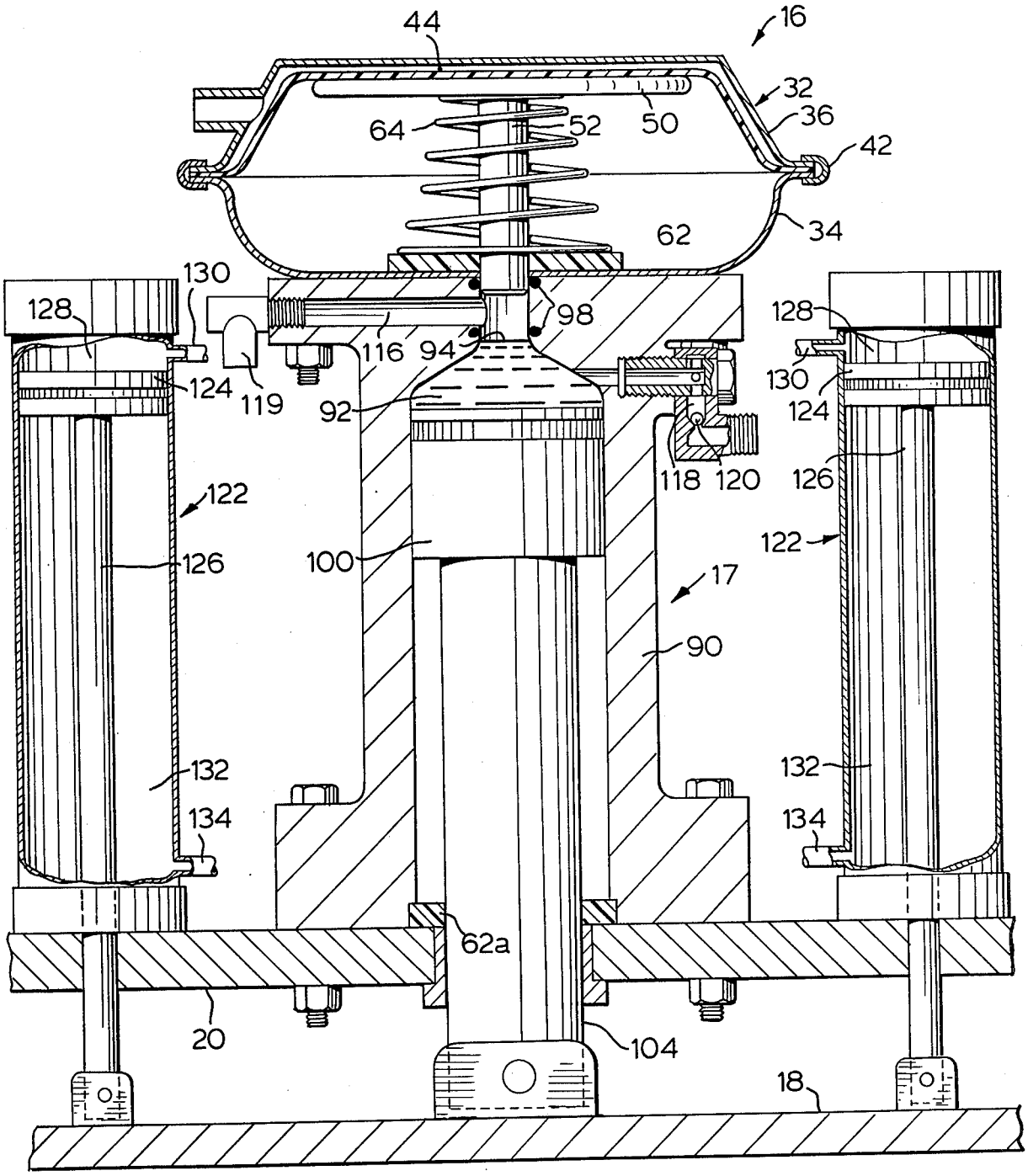
FIG. 5 is a longitudinal sectional view through a pneumatic drive unit incorporating a primary and secondary drive and an extensible primary drive shaft.

In certain applications, it is necessary to move the pressure plate 18 a considerable distance away from the base plate 14 to permit a work piece to be located between the components of the tool to be used in the apparatus. For example, it may be necessary to move the components of a press tool away from one another a distance sufficient to receive a large diameter tubular member in which holes are to be punched through the wall thereof. The wall of the tubular member may be relatively thin so that only a short working stroke is required although a large opening stroke is required in order to permit the work piece to be operably located within the press. The apparatus of FIG. 5 achieves the power multiplying characteristics of the apparatus of FIG. 4 while also providing a long opening stroke in combination with a short working stroke. The pneumatic drive unit 16 and multiplier 17 of the apparatus of FIG. 5 are the same as those described with reference to FIG. 4 except that a second O-ring 98 is provided immediately below vent hole 116; and the bleed nipple 117 is replaced by a check valve 121 leading away from chamber 92 to the oil reservoir. The apparatus of FIG. 5 differs from that of FIG. 4 in that secondary pneumatic cylinders 122 are provided in place of the reset springs 114. Each of the units 122 has a piston 124 slidably mounted therein and a piston rod 126 extending outwardly from the piston 124 and connected flexibly to the pressure plate 18. Air is supplied to the upper chamber 128 of the cylinders 122 by air lines 130 and to the lower cylinder 132 by air lines 134.

Figure 6:
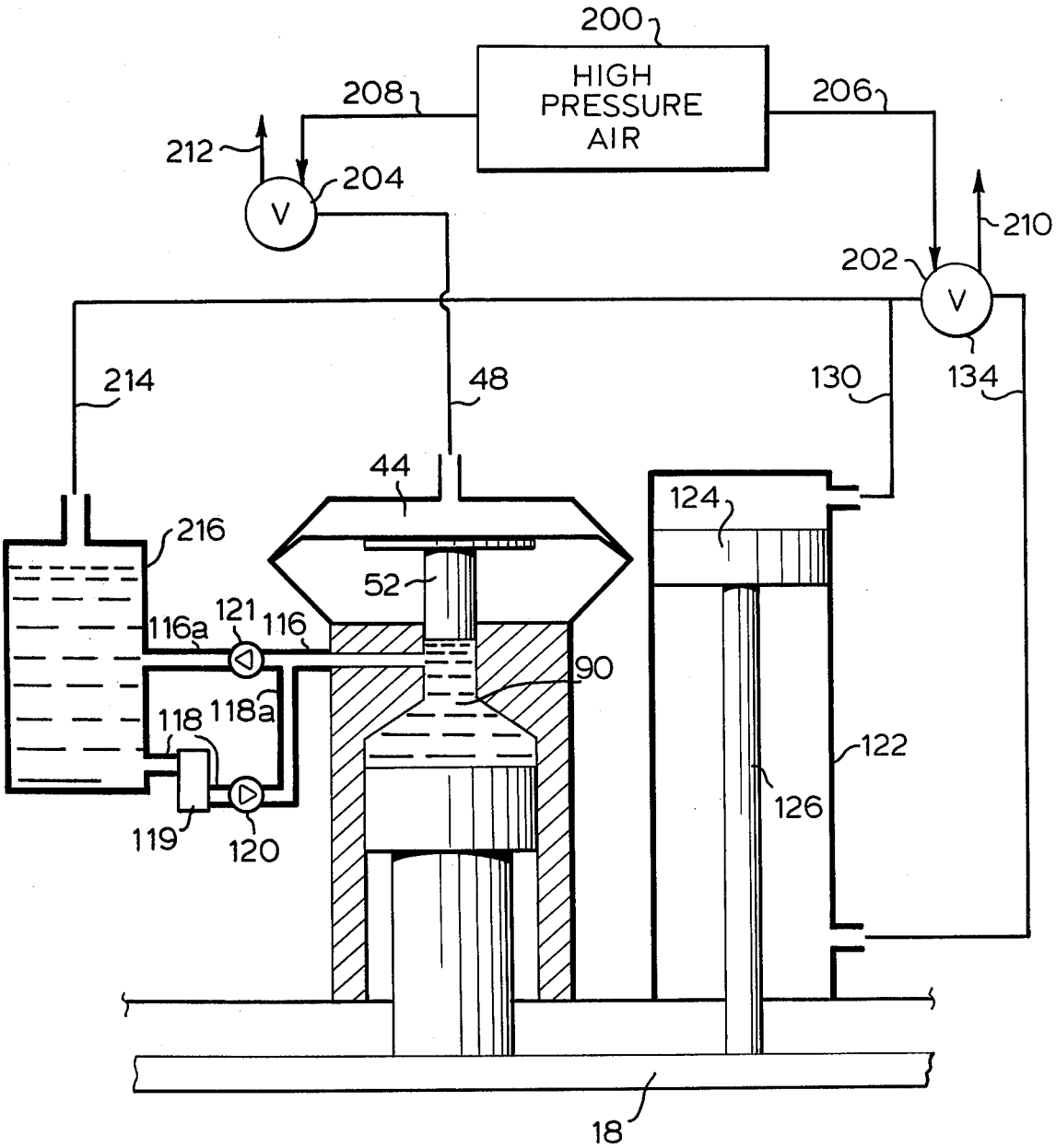
FIG. 6 is a diagrammatic representation of the power circuit of a press according to the embodiment illustrated in FIG. 5.

FIG. 6 of the drawings diagrammatically illustrates the control circuit of a press constructed in accordance with FIG. 5 of the drawings. As shown in FIG. 6 of the drawings, a source of high pressure air is designated by the reference numeral 200 and is connected to a first valve 202 and a second valve 204 by lines 206 and 208, respectively. An exhaust line 210 opens from the valve 202 and an exhaust line 212 opens from the valve 204. The valve 202 has outlets communicating with the lines 130 and 134 of the pneumatic cylinder 122, respectively. The valve 204 has outlets communicating with line 48 of the diaphragm and line 214 which leads to oil reservoir 216. The oil reservoir 216 is connected to the pressure multiplier 17 through lines 116 and 118.

When the apparatus is in the rest position illustrated in FIG. 6 of the drawings, air pressure is supplied by way of valve 202 to line 134 so as to retain the pressure bar in the elevated position. Line 130 is vented through valve 202. Similarly, lines 48 and 214 are vented to atmosphere through valve 204. To initiate a working stroke, valve 202 is activated to admit high pressure air from the line 206 to line 130 and to vent the line 134 through line 210. Thus, the pressure bar 18 is driven downwardly by the cylinders 122 to be located more closely adjacent the work piece. Simultaneously, the valve 202 is adjusted to supply air under pressure to the line 214 to pressurize the oil reservoir so that as the piston 100 moves downwardly with the pressure bar 118, oil from the oil reservoir is admitted to the cylinder 92 by way of lines 116 and 118. When the pressure bar has reached a predetermined lowered position, the valve 204 is adjusted to direct high pressure air to the line 48 and thus to the diaphragm chamber 44. The diaphragm chamber 44 is expanded and the shaft 52 is driven downwardly into the chamber 90 to close passage 116. The check valve 120 closes automatically to prevent oil returning to the reservoir through line 118. Further downward movement of the shaft 52 applies pressure to the piston 100 to drive the piston downwardly and thus drive the pressure bar over its working stroke. When the working stroke has been completed, valve 204 is moved to a position in which line 48 is vented to atmosphere and valve 202 is moved to a position in which line 130 and line 214 is vented to atmosphere and line 134 is connected to the source of high pressure air through line 206. Air is supplied through line 134 to cylinder 122 to raise piston 124, and thereby raise pressure bar 18. Pressure bar 18 raises piston 100 which in turn raises shaft 52 until line 116 is opened to permit hydraulic fluid from chamber 90 to return to reservoir 216, whereupon the piston 100 continues to rise in the cylinder to return to the at rest position shown in FIG. 6.

As will be seen from the foregoing discussion of the operation of this apparatus, the required high load pressure is achieved over the short working stroke and the required opening of the components of a tool can be achieved by the adjustment provided by the secondary pneumatic drive cylinders 122.

From the foregoing, it will be apparent that the present invention provides various pneumatic drive units for use in a press, each unit having a different characteristic making it suitable for a particular installation. The unit of FIG. 2 is simple and inexpensive and provides a substantial stroke length with a moderate power output. The unit of FIG. 3 retains the stroke length of FIG. 1 and provides an increased power output. The unit of FIG. 4 provides a considerably greater power output than that available from FIG. 1. However, the length of the stroke which is available is proportionally reduced. The unit of FIG. 5 provides the increased power output available from the apparatus of FIG. 4 in combination with a mechanism for positioning the pressure plate closely adjacent the work piece prior to commencement of the working stroke.

From the foregoing, it will be apparent that the pneumatic drive mechanisms of the present invention are inexpensive to manufacture and are simple in their operation. A plurality of pneumatic drive units of any of the types described above with reference to FIGS. 2 to 5 of the drawings may be used in association with a press of the type illustrated in FIG. 1 of the drawings or in any other press unit.

I claim:

1. In a press having a frame, a base plate on said frame, a pressure plate mounted on said frame for movement towards and away from said base plate, at least one punch assembly located between said base plate and said pressure plate, each punch assembly having a working stroke operable in response to movement of said pressure plate with respect to said base plate, the improvement of; at least one pneumatic drive unit, each pneumatic drive unit comprising;

a. a housing having a main chamber located therein, b. a pressure responsive diaphragm mounted in said housing and dividing said main chamber into a pressure chamber and a vent chamber, c. air inlet passage means opening into said housing and communicating with said pressure chamber for supplying air under pressure to said pressure chamber to activate said diaphragm, d. a substantially rigid stiffener plate mounted below said diaphragm, e. a drive shaft having an inner end mounted on said stiffener plate for movement therewith in response to movement of said diaphragm and an outer end projecting outwardly from said housing through said vent chamber and communicating with said pressure plate to drive said pressure plate and thereby drive said punch assembly in response to movement of said diaphragm, f. shock absorber means underlying said stiffener plate to absorb the impact of the stiffener plate following the release of the punch after penetration of a work piece during a working stroke thereof.

2. A press as claimed in claim 1 wherein said shock absorber means comprises a pad of resilient material mounted in said housing and underlying said stiffener plate.

3. A press as claimed in claim 2 wherein said shock absorber material is a urethane cushion.

4. A press as claimed in claim 1 including longitudinally elongated bearing means mounted in said housing and slidably engaging said shaft.

5. In a press having a frame, a base plate on said frame, a pressure plate mounted on said frame for movement towards and away from said base plate, at least one punch assembly located between said base plate and said pressure plate, each punch assembly having a working stroke operable in response to movement of said pressure plate with respect to said base plate, the improvement of; at least one pneumatic drive unit, each pneumatic drive unit comprising;

a. a housing having a plurality of main chambers disposed one above the other, b. a pressure responsive diaphragm mounted in each main chamber and dividing each main chamber into a pressure chamber and a vent chamber, c. air inlet passage means opening through said housing into each of said pressure chambers for supplying air under pressure to each pressure chamber to activate each diaphragm, d. a substantially rigid stiffener plate mounted below each diaphragm, e. drive shaft means extending within said main chamber and having one end projecting outwardly therefrom and connected to said pressure plate, said drive shaft being drivingly connected to each of said stiffener plates for movement therewith in response to movement of said diaphragm whereby the pressure within each pressure chamber is applied to said drive shaft means, f. shock absorber means underlying at least the lowermost stiffener plate to absorb the impact of said lowermost stiffener plate following the release of the punch after penetration of a work piece during a working stroke thereof.

6. A press as claimed in claim 5 wherein said air inlet passage means are connected in parallel to a source of air.

7. A press as claimed in claim 5 wherein said shock absorber means comprises a pad of resilient material mounted in said housing and underlying said stiffener plate.

8. A press as claimed in claim 5 wherein said shock absorber material is a urethane cushion.

9. A press as claimed in claim 5 including longitudinally elongated bearing means mounted in said housing and slidably engaging said shaft.

10. A press as claimed in claim 1 including a pressure multiplier disposed between said housing and said frame, said pressure multiplier comprising, a. a multiplier housing having a multiplier fluid chamber formed therein, b. said multiplier fluid chamber having a first portion opening outwardly from one end of said housing and adapted to sealingly receive said drive shaft in a close fitting sliding relationship, and a second portion of greater cross-sectional area than said first portion, said second portion opening outwardly from the other end of said housing, c. a piston slidably mounted in said second portion and having a piston rod projecting outwardly through said other end of said housing and engaging said pressure plate, and d. reset means for resetting said pressure multiplier and pneumatic drive unit on completion of a working stroke.

11. In a press having a frame, a base plate on said frame, a pressure plate mounted on said frame for movement towards and away from said base plate, at least one punch assembly located between said base plate and said pressure plate, each punch assembly having a working stroke operable in response to movement of said pressure plate with respect to said base plate, the improvement of; a drive mechanism comprising a primary drive mechanism operable to drive the punch mechanism in its working stroke and a secondary drive mechanism operable to locate the punch closely adjacent the work piece prior to commencement of the working stroke, said primary drive mechanism comprising at least one primary drive unit comprising;

a. a main housing having a main chamber located therein, b. a pressure responsive diaphragm mounted in said housing and dividing said main chamber into a pressure chamber and a vent chamber, c. air inlet passage means opening into said housing and communicating with said pressure chamber for supplying air under pressure to said chamber to activate said diaphragm, d. a substantially rigid stiffener plate disposed below said diaphragm, e. a drive shaft having an inner end mounted on said stiffener plate for movement therewith in response to movement of said diaphragm, and an outer end projecting outwardly from said housing through said vent chamber, f. shock absorber means underlying said stiffener plate to absorb the impact of the stiffener plate following the release of the punch mechanism after penetration of the work piece during said working stroke, g. a pressure multiplier housing disposed between said main housing and said frame, h. a fluid chamber in said pressure multiplier housing, said fluid chamber having a first portion opening outwardly from one end thereof and adapted to sealingly receive said outer end of said drive shaft in a close fitting sliding relationship, and a second portion of greater cross-sectional area than said first portion, said second portion opening outwardly from the other end of said housing, i. a piston slidably mounted in said second portion and having a piston rod projecting outwardly through said other end of said housing and engaging said pressure plate, j. an hydraulic fluid reservoir, and passage means communicating between said fluid chamber and said reservoir, k. valve means in said passage means controlling the admission of fluid to said fluid chamber and the venting of fluid from said fluid chamber;

said secondary drive mechanism comprising at least one secondary drive unit comprising;

1. a longitudinally extensible unit having a first end secured to said frame and a second end secured to said pressure plate, said longitudinally extensible unit being extensible in a first direction to move said pressure plate and thereby move said piston of said pressure multiplier away from said shaft of said primary drive unit and thereby expand the capacity of said fluid chamber and draw hydraulic fluid into said fluid chamber, thereby increasing the effective length of said primary drive, m. said longitudinally extensible unit being retractable to lift said pressure plate away from a work piece and vent hydraulic fluid from said fluid chamber upon completion of said working stroke of said primary drive mechanism.

12. In a press having a frame, a base plate on said frame, a pressure plate mounted on said frame for movement towards and away from said base plate, at least one punch assembly located between said base plate and said pressure plate, each punch assembly having a working stroke operable in response to movement of said pressure plate with respect to said base plate, the improvement of, at least one pneumatic drive unit, each pneumatic drive unit comprising;

a. primary pneumatic drive means comprising, i. an expansible diaphragm valve member having a diaphragm which is movable in response to a variation in pressure in the valve member, ii. an hydraulically extensible drive unit connecting said diaphragm and said pressre plate, said hydraulically extensible drive unit having an expansible hydraulic chamber located therein and being movable between an extended position and a retracted position in response to expansion and contraction of said expansible hydraulic chamber, iii. a source of hydraulic fluid communicating with said expansible hydraulic chamber for supplying hydraulic fluid to said chamber as said hydraulically extensible drive unit expands and receiving hydraulic fluid from said expansible chamber as said hydraulically extensible drive unit contracts;

b. said secondary drive means comprising, i. an extensible second drive unit having a first end connected to said frame and a second end connected to said pressure plate, said second drive means being extensible and retractable to move said pressure plate over a substantial distance towards and away from a work piece to expand and contract said hydraulically extensible drive unit of said primary drive. means.

* * * * *